US011640814B1

(12) United States Patent
Fukai

(10) Patent No.: US 11,640,814 B1
(45) Date of Patent: May 2, 2023

(54) SUSPENSION SYSTEM FOR A DRUM

(71) Applicant: Pearl Musical Instrument Co., Yachiyo (JP)

(72) Inventor: Yuji Fukai, Yachiyo (JP)

(73) Assignee: PEARL MUSICAL INSTRUMENT CO., Chiba (JP)

( * ) Notice: Subject to any disclaimer, the term of this patent is extended or adjusted under 35 U.S.C. 154(b) by 0 days.

(21) Appl. No.: 17/723,564

(22) Filed: Apr. 19, 2022

(51) Int. Cl.
*G10D 13/00* (2020.01)
*G10D 13/10* (2020.01)

(52) U.S. Cl.
CPC ..... *G10D 13/28* (2020.02)

(58) Field of Classification Search
CPC ..... G10D 13/00; G10D 13/26; G10D 13/28
See application file for complete search history.

(56) References Cited

U.S. PATENT DOCUMENTS

| | | | |
|---|---|---|---|
| 2,433,594 | A | 8/1946 | Calo |
| 3,780,613 | A | 12/1973 | Ludwig, Jr. |
| 4,158,980 | A | 6/1979 | Gauger |
| 5,353,674 | A | 10/1994 | Volpp |
| 5,404,786 | A | 4/1995 | Gatzen |
| 5,454,288 | A | 10/1995 | Hosino |
| 5,477,767 | A | 12/1995 | May |
| 5,520,083 | A | 5/1996 | Falkner, Jr. |
| 5,544,561 | A | 8/1996 | Isomi |
| 5,645,253 | A | 7/1997 | Hoshino |
| 5,721,389 | A | 2/1998 | Kleindienst et al. |
| 6,552,253 | B1 | 4/2003 | Chen |
| 7,906,718 | B1 | 3/2011 | Liao |
| 7,919,701 | B2 | 3/2011 | Yang |
| 8,168,873 | B2 | 5/2012 | Okamoto |
| 8,237,038 | B2 | 8/2012 | Gauger |
| 8,431,808 | B2 | 4/2013 | Nakata et al. |
| 9,024,163 | B2 | 5/2015 | Sato et al. |
| 9,613,603 | B2 | 4/2017 | Allen |
| 10,249,273 | B1 | 4/2019 | May |
| 2017/0040006 | A1* | 2/2017 | Martin ..... G10D 13/28 |

* cited by examiner

*Primary Examiner* — Kimberly R Lockett
(74) *Attorney, Agent, or Firm* — Manelli Selter PLLC; Edward Stemberger

(57) ABSTRACT

A suspension system for a drum includes upper and lower suspension structures defining a pair of mounting holes including an upper and a lower mounting hole. A vibration isolation member is received in each mounting hole of the pair. When the suspension system is mounted to the drum via the pair of mounting holes and an associated vibration isolation members receives an associated tensioning rod at a support location, one of the vibration isolation members engages a downwardly facing surface of the upper drum hoop and the other vibration isolation member engages a downwardly facing surface of a lower lug to support weight of the drum upwardly. The suspension system prevents a moment force on the drum when the drum is oriented in a horizontal or angled position due to the support locations being oriented to be balanced with respect to a center of gravity of the drum.

20 Claims, 21 Drawing Sheets

SUSPENSION SYSTEM FOR A DRUM

FIELD

The present invention is directed to a suspension system for drum, and more particularly, to a suspension system that is configured to support a drum in a balanced manner

BACKGROUND

When the drum head of a drum (e.g., a tom-tom drum) is tuned with precisely even tension and the drum shell keeps is perfect roundness, the drum is supposed to make the best tone and sustain of sound. However, in the majority of cases, the drums are installed with mounts that deform the drum heads and drum shell. The deformation that makes the sound worse is caused by the drum being unbalanced.

U.S. Pat. No. 4,158,980 discloses a mounting bracket for a drum. With reference to FIG. 1A, no moment force is created when the mounting bracket (not shown) is installed and the drum 10 is oriented horizontally, since the mounting support locations L are on a plane P oriented along the center of gravity C of the drum 10. However, with reference to FIG. 1B, when the mounting bracket is installed and the drum 10 is oriented at an angle with respect to horizonal, mounting support locations L are no longer on a plane oriented along the center of gravity C of the drum 10. Thus, a moment force F is generated due to the weight of the drum 10 and the drum is thus unbalanced.

Therefore, a need exists for a suspension for a drum that ensures balance of the drum no matter how the drum is oriented upon mounting.

SUMMARY

An aspect of an embodiment provides a suspension system for a drum. The drum has a cylindrical drum shell, upper and lower drum heads fitted over respective first and second opposing ends of the drum shell, upper and lower drum hoops on the shell and retaining the respective upper and lower drum heads to the shell, upper and lower of lugs fixed to portions of a periphery of the drum shell, and a plurality of adjustable upper and lower tensioning rods securing the respective upper and lower drum hoops to the respective upper and lower lugs. Certain pairs of tensioning rods are disposed 180 degrees apart with regard to a circumference of the drum. The suspension system includes upper and lower suspension structures each configured to surround a portion of a circumference of the drum when mounted thereon near the respective upper and lower drum hoops. Each of the upper and lower suspension structures has at least one distal end with each distal end having a mounting hole thereby defining a mounting hole pair including at least one upper mounting hole in the upper suspension structure and at least one lower mounting hole in the lower suspension structure such that the at least one lower mounting hole is disposed 180 degrees apart from the at least one upper mounting hole. The at least one upper mounting hole is configured to receive at least one tensioning rod of a certain pair of tensioning rods, and the at least one lower mounting hole is configured to receive the other tensioning rod of the certain pair of tensioning rods. A connection structure is mounted between the upper and lower suspension structures and is configured for adjusting a spacing between the upper and lower suspension structures. The connection structure has clamping structure including an adjustable opening configured to receive a holding rod and to clamp upon and hold the holding rod in fixed relation with respect to the connection structure. A vibration isolation member is removably disposed in the at least one upper mounting hole and the at least one lower mounting hole to define support locations to support the drum when installed with respect to the suspension structures. Each vibration isolation member has a bore there-through for receiving a tensioning rod, and are configured to isolate vibration between the drum and the suspension structures.

When the suspension system is mounted to the drum by each mounting hole and associated vibration isolation member receiving an associated tensioning rod at a support location, the vibration isolation member mounted in the at least one upper mounting hole is configured to engage a downwardly facing surface of the upper drum hoop and the vibration isolation member mounted in the at least one lower mounting hole is configured to engage a downwardly facing surface of a lower lug to support weight of the drum upwardly. The suspension system is constructed and arranged to prevent a moment force on the drum when the drum is oriented in a horizontal position and in a position angled with respect to the horizontal position due to the support locations being oriented to be balanced with respect to a center of gravity of the drum.

Other aspects of the embodiments, including apparatus, articles, methods, systems, assemblies, and the like which constitute part of the invention, will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description, serve to explain the principles of the invention. In such drawings.

DETAILED DESCRIPTION OF EXAMPLE EMBODIMENTS

Reference will now be made in detail to exemplary embodiments of the invention. It should be noted, however, that the invention in its broader aspects is not necessarily limited to the specific details, representative materials and methods, and illustrative examples shown and described in connection with the exemplary embodiments.

Figure 1A:
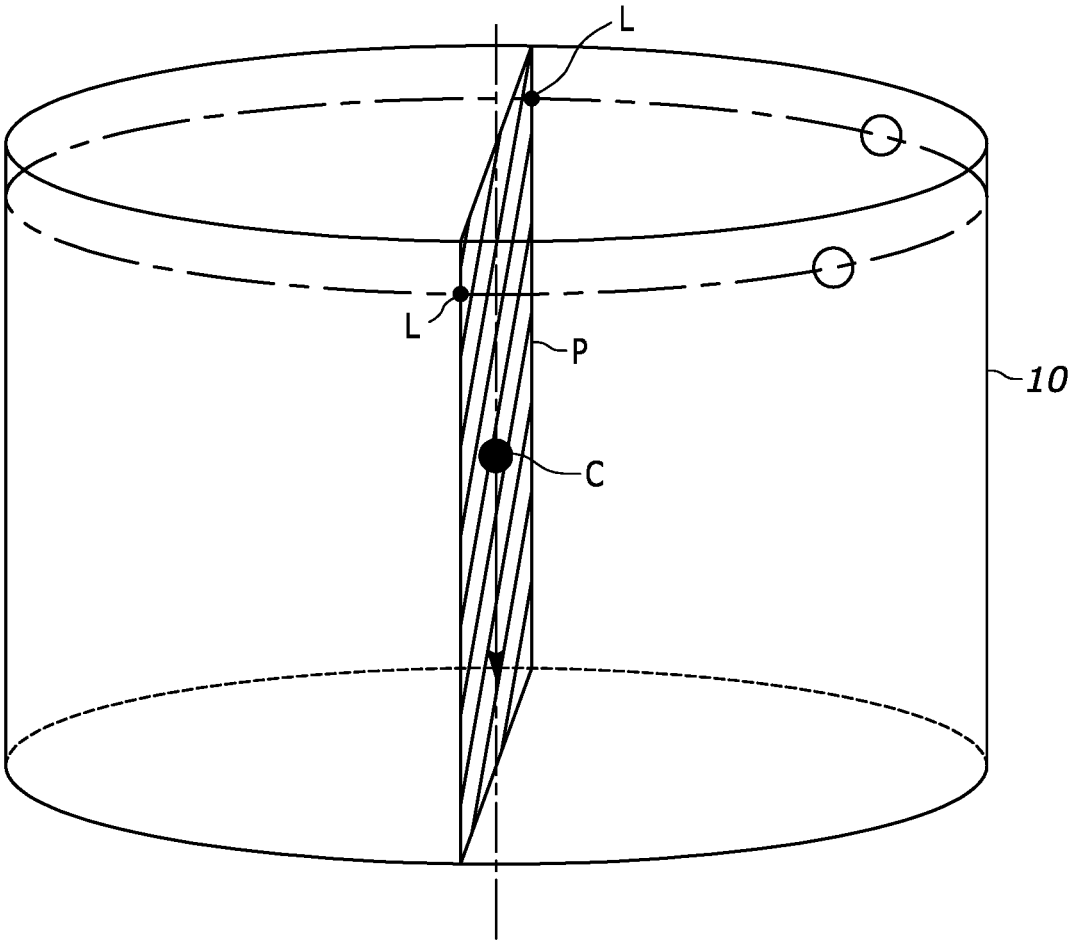
FIG. 1A is a schematic view of a conventional drum showing a plane of mounting support locations along a center of gravity of the drum when the drum is in a horizonal orientation.
Figure 1B:
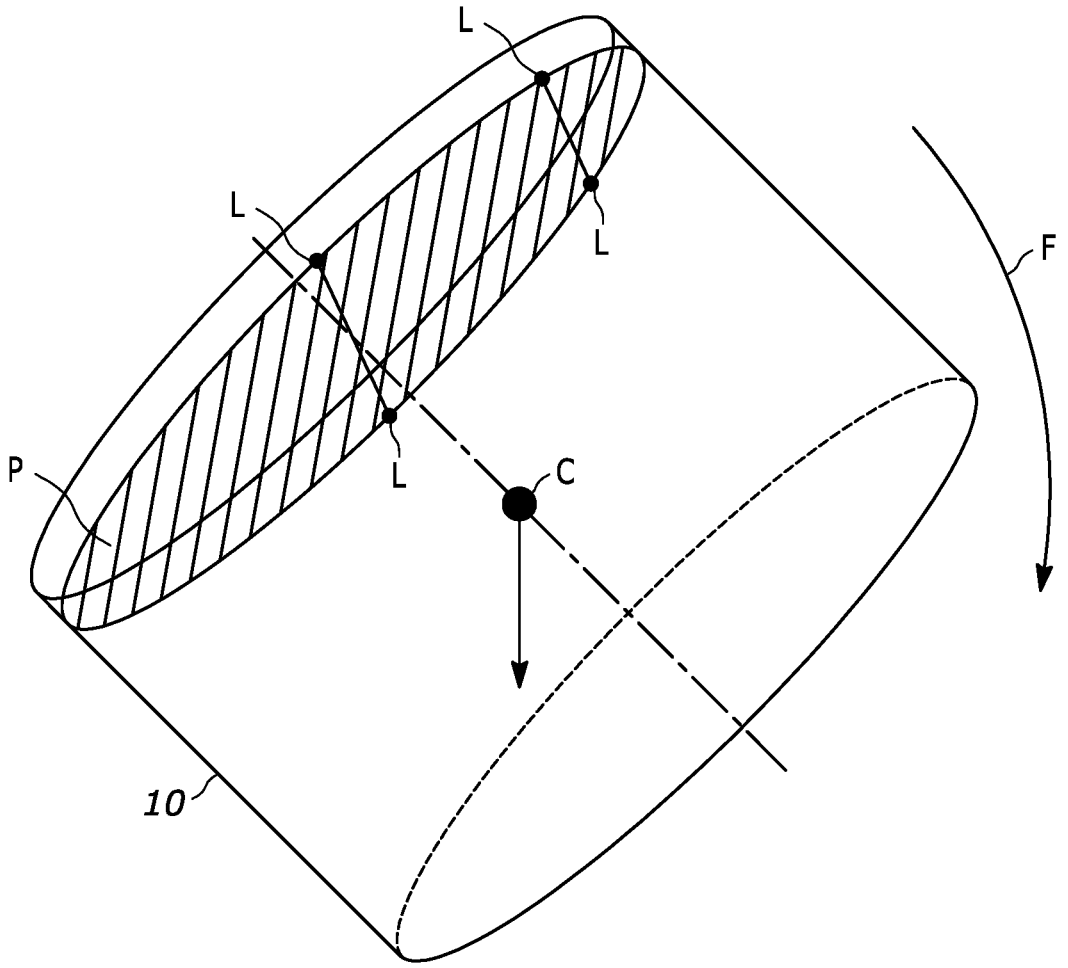
FIG. 1B is a schematic view of the drum of FIG. 1A, but showing the plane of mounting support locations no longer along a center of gravity of the drum and a generated moment force on the drum when the drum is oriented at an angle with respect to horizontal.
Figure 2:
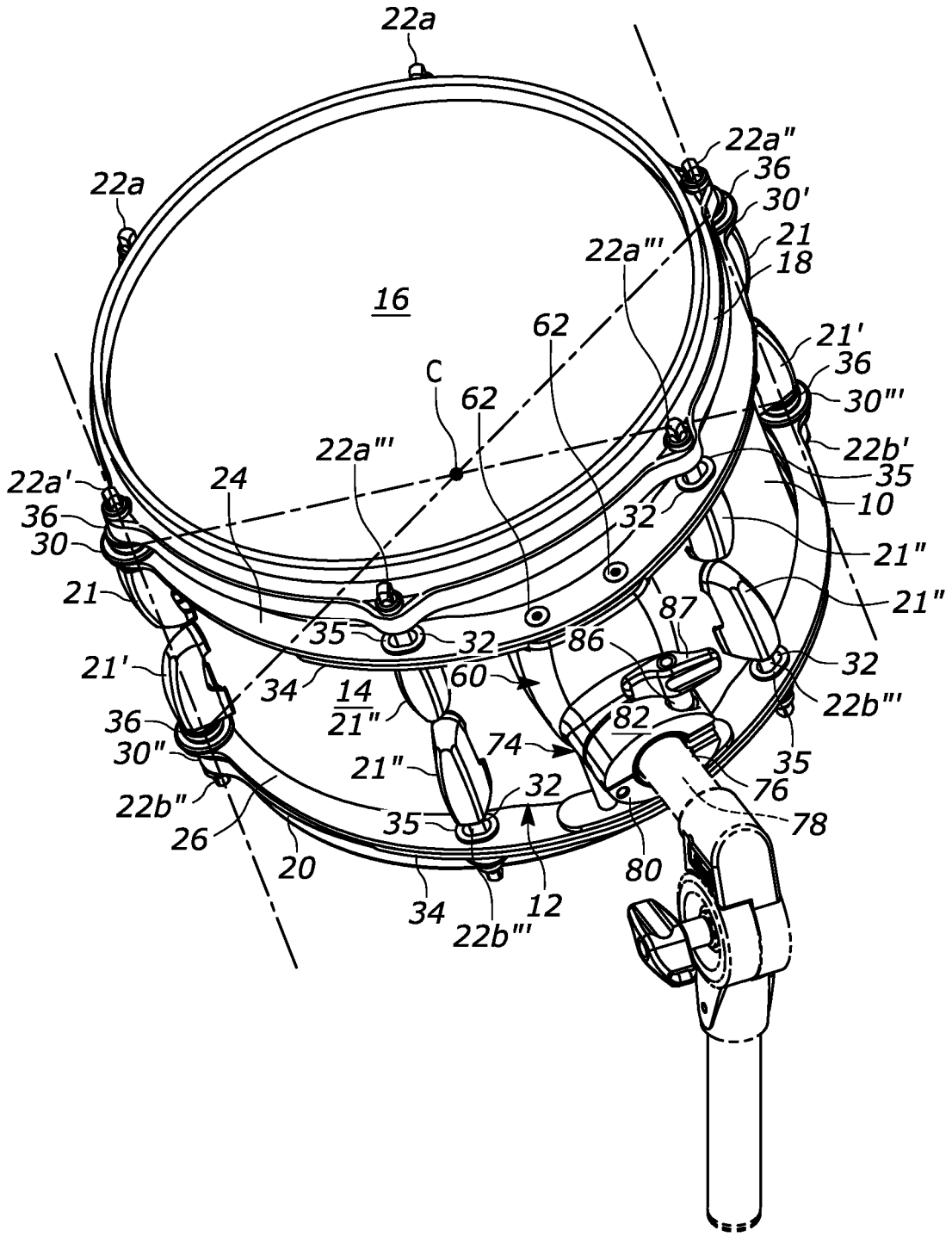
FIG. 2 is a perspective view of a suspension system in accordance with a first exemplary embodiment of the present disclosure, shown mounted to a drum.

FIG. 2 is a perspective view of a suspension system, shown generally indicated at 12, in accordance with a first exemplary embodiment of the present disclosure, shown mounted to a drum 10, such as a tom-tom drum. The drum 10 is conventional and has a cylindrical drum shell 14. An upper drum head 16 and a lower drum head (not visible) is fitted over respective first and second opposing ends of the drum shell 14. An upper drum hoop 18 retains the upper drum head 16 on the shell 14 and a lower drum hoop 20 retains the lower drum head on the shell 14. Upper lugs 21 and lower lugs 21' are fixed to portions of a periphery of the drum shell 14. A plurality of adjustable upper tensioning rods 22*a*', 22*a*" secure the upper drum hoop to upper lugs 21, and a plurality of adjustable lower tensioning rods 22*b*', 22*b*" secure the lower drum hoop to lower lugs 21'. Certain pairs of tensioning rods (e.g., rod pairs 22*a*', 22*b*'; rod pairs 22*a*", 22*b*") are disposed 180 degrees apart with regard to a circumference of the drum 10, on opposing sides of the drum 10, as will be explained more fully below.

Figure 3:
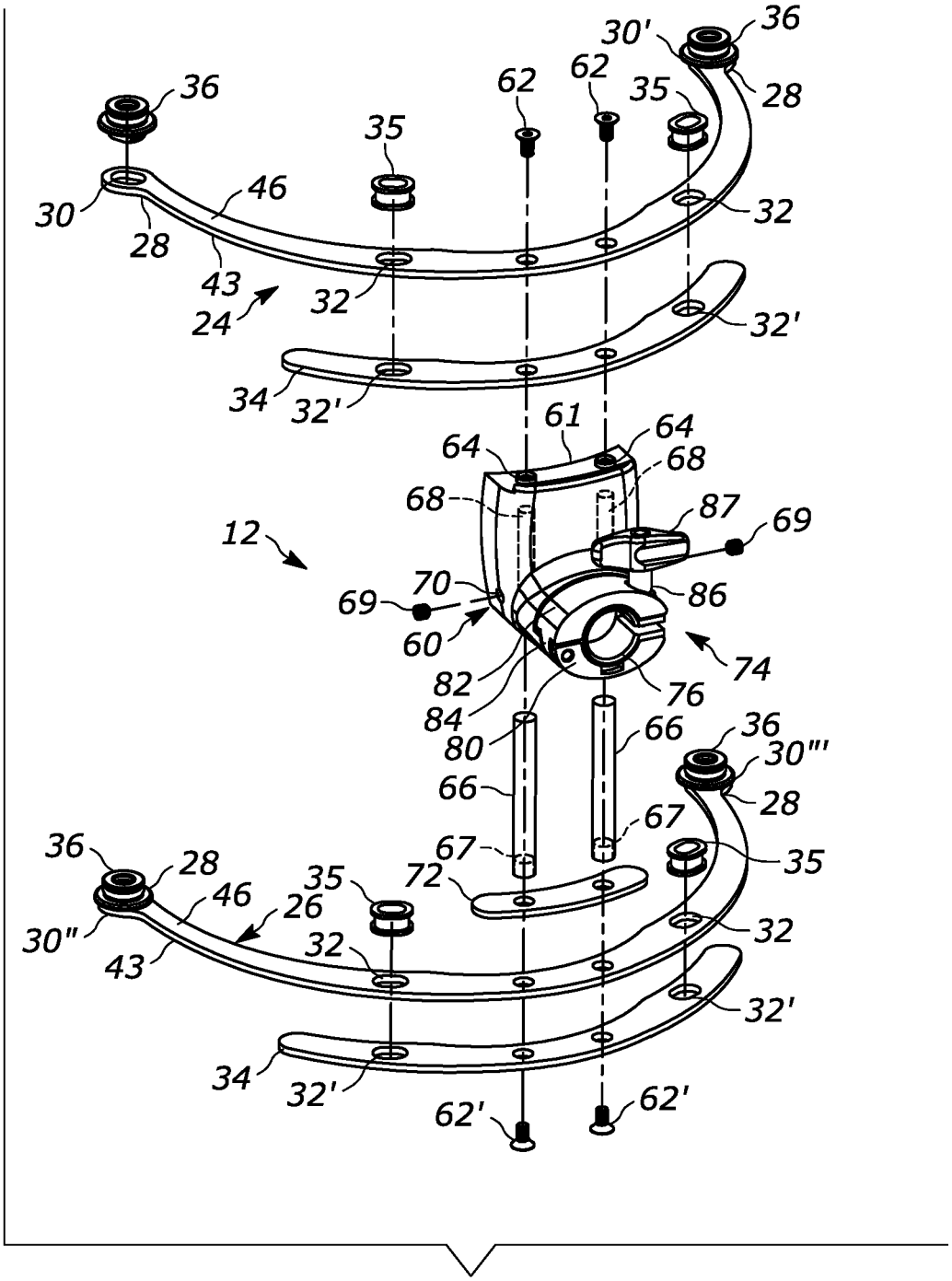
FIG. 3 is an exploded view of the suspension system of FIG. 2.

With reference to FIGS. 2 and 3, the suspension system 12 includes an upper suspension structure 24 and a lower suspension structure 26, each configured to surround a portion of a circumference of the drum 10 when mounted thereon near the respective upper and lower drum hoops 18, 20. Each of the upper and lower suspension structures 24, 26 is the form of a flat arcuate plate of identical configuration. For manufacturing ease, each upper and lower suspension structures 24, 26 can be of two part configuration.

As shown in FIG. 3, each of the upper and lower suspension structures 24, 26 has a pair of distal ends 28. Each distal end 28 of the upper suspension structure 24 has an upper mounting hole therein. One mounting hole 30 in the upper suspension structure 24 and one mounting hole 30'" in the lower suspension structure 26 that is disposed 180 degrees apart from the one mounting hole 30 in the upper suspension structure 24 define mounting holes pairs. It is noted that when upper and lower suspension structures are mounted to the drum 10, mounting hole 30 is at an upper portion of the drum 10, while mounting hole 30'" is located at a lower portion of the drum. Another set of mounting hole pairs is defined by mounting holes 30' and 30", such that when upper and lower suspension structures 24, 26 are mounted to the drum 10, mounting hole 30' is at an upper portion of the drum 10, while mounting hole 30" is located at a lower portion of the drum. Thus, as shown in FIG. 2, mounting hole 30 is configured to receive tensioning rod 22*a*', the mounting hole 30'" is configured to receive tensioning rod 22*b*', mounting hole 30' is configured to receive tensioning rod 22*a*", and mounting hole 30" is configured to receive tensioning rod 22*b*".

Figure 4:
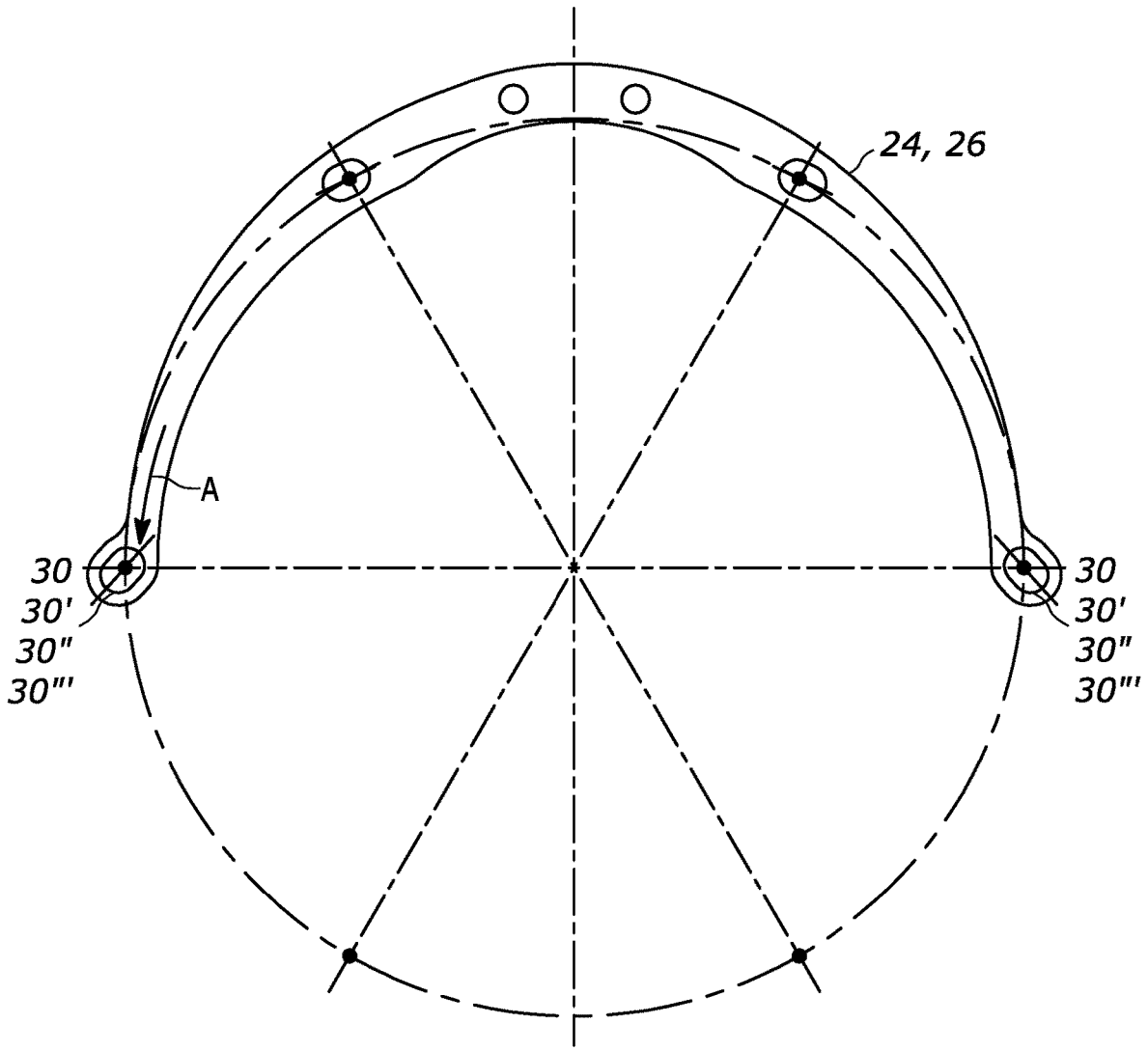
FIG. 4 is a plan view of an upper suspension structure of the suspension system of FIG. 3, showing mounting holes offset from a circumferential direction.

With reference to FIG. 4, each mounting hole 30, 30', 30" and 30'" is in the form of an elongated slot so as to not be parallel to another slot of each suspension structure 24, 26. Thus, the offset slots prevent slip of the suspension system 12 when mounted on the drum 10, even when the drum 10 is tilted in the circumferential direction A. Also, the width of the slots accommodates variation of tensioning rod position due to manufacturing tolerances or tensioning rods provided by different drum manufacturers. Thus, the symmetrically angled slots permit changeable pitch/distance of two mounting locations.

As shown in FIGS. 2 and 3, each of the upper and lower suspension structures 24, 26 includes a pair of secondary mounting holes 32 spaced from the distal ends 28 and constructed and arranged to receive an associated tensioning rod 22*a*'" or 22*b*'" in a floating manner Each of the upper and lower suspension structures 24, 26 optionally includes a reinforcement plate 34 fixed thereto to reinforce the associated suspension structure 24, 26. Each reinforcement plate is arc-shaped to correspond with a portion of the arc-shaped suspension structure 24, 26. Each reinforcement plate 34 includes secondary mounting holes 32' that correspond with an associated mounting hole 32. Each of the mounting hole pairs 32, 32' includes a rubber insert 35 that receives an associated tensioning rod in a flotating manner The rubber insert 35 prevents any metal to metal contact between a tensioning rod and suspension structure 24, 26.

With reference to FIGS. 2 and 3, a rubber vibration isolation member 36, is removably disposed in the at least one upper mounting hole, e.g., hole 30' and the at least one lower mounting hole e.g., 30" to define support locations and support the drum 10 when installed with respect to the suspension structures 24, 26, as will be explained more fully below. In the illustrated embodiment, each of the upper mounting holes 30, 30' and each of the lower mounting holes 30", 30'" includes a vibration isolation member since, as shown in FIG. 2, the drum 10 is supported at four support locations.

Figure 5B:
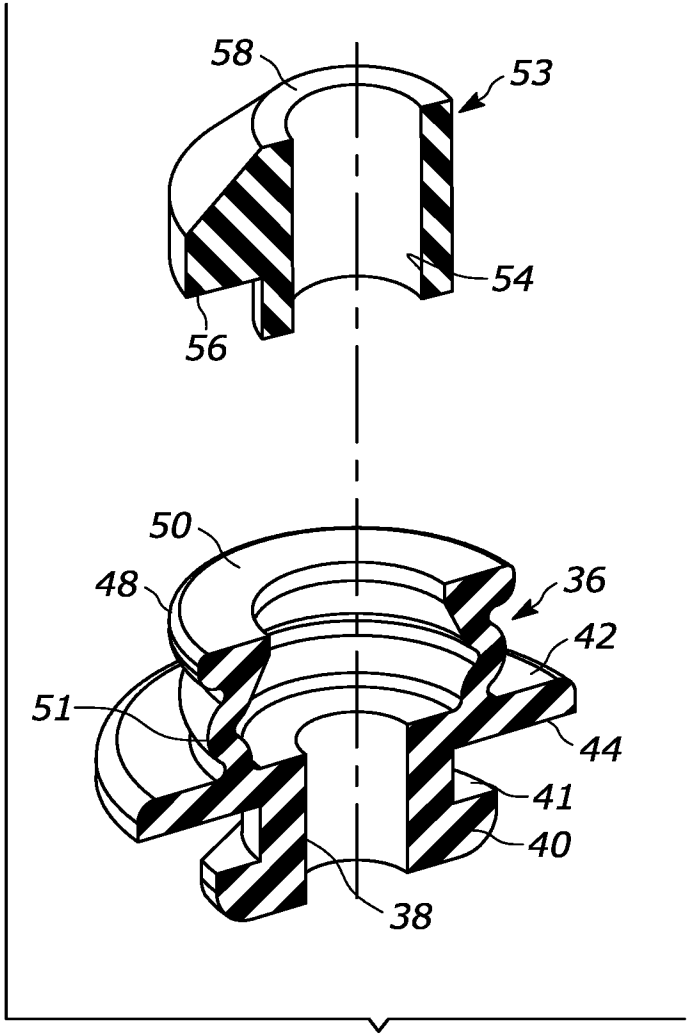
FIG. 5B is cross-sectional view of the vibration isolation member and spacer of FIG. 5A.
Figure 5A:
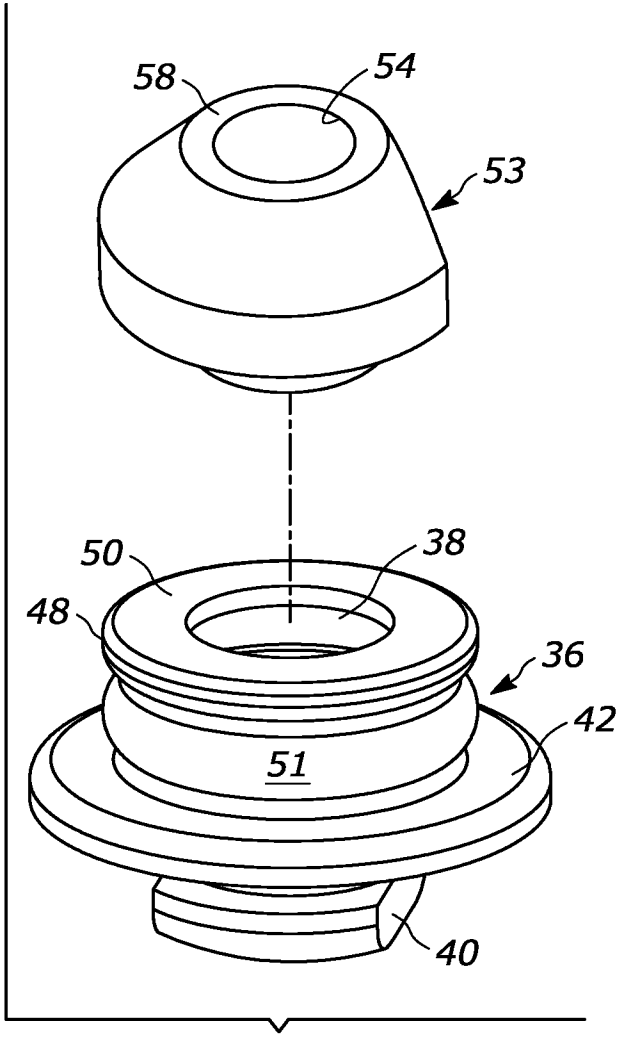
FIG. 5A is an enlarged exploded sectional view of a vibration isolation member of the suspension system of FIG. 3, shown with a cooperating, optional spacer.

As best seen in the enlarged views of FIGS. 5A and 5B, each vibration isolation member 36 has a bore 38 therethrough for receiving a tensioning rod; a bottom portion 40 configured to engage surfaces of a mounting hole 30, 30', 30", 30'", and having a generally planar upwardly facing surface 41 for engaging an downwardly facing surface 43 of an associated suspension support structure 24, 26; a central portion 42 having a generally planar downwardly facing surface 44 for engaging an upwardly facing surface 46 of an associated suspension support structure 24, 26; a top portion 48 having an upwardly facing surface 50 for engaging a portion of the drum hoop 18 (e.g., a die cast hoop), and a bellows 51, generally adjacent to surface 50 and between the top portion 48 and central portion 42 to permit the vibration isolation member 36 to buckle easily. Each vibration isolation member 36 is configured so that the central portion 42, the bellows 51 and top portion 48 thereof extend beyond the upwardly facing surface 46 of the suspension structures 24, 26.

Figure 5C:
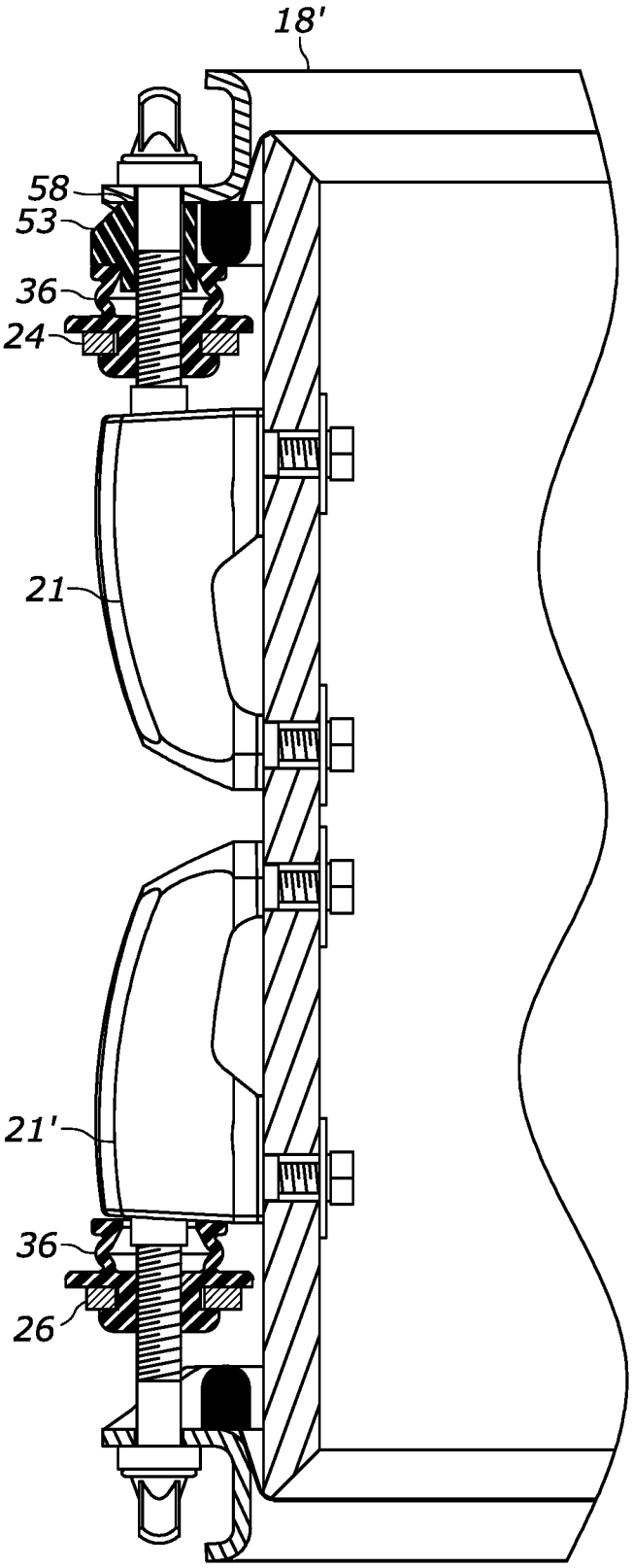
FIG. 5C is a partial sectional view of the spacer provided between a flanged metal hoop and the vibration isolation member of an embodiment.

In the embodiment of FIGS. 5A and 5B, the upwardly facing surface 50 is planar so as to engage a planar surface 52 (FIG. 7) of the upper drum hoop 18 when the drum hoop is a die-cast hoop. With reference to FIG. 5C, when the upper drum hoop 18 is of the flanged metal hoop 18' type, an additional rubber spacer 53 (FIGS. 5A, 5B) is provided, having a through bore 54 that aligned with bore 38 of the vibration isolation member. A downwardly facing surface 56 of the spacer 53 is planar and rests on surface 50 of the vibration isolation member 36. An upper surface 58 of the spacer 53 engages a downwardly facing surface of the flanged metal hoop 18'. The spacer 53 can be considered to be part of the vibration isolation member 36 (made integral therewith) and can be used with any flanged metal hoop such as, but not limited to, a double flange hoop, a triple flange hoop, or any other flanged metal hoop that would require the spacer 53.

Returning to FIG. 3, the suspension system 12 includes a connection structure, generally indicated at 60, that is adjustably mounted between the upper and lower suspension structures 24, 26. In the embodiment of FIG. 3, the upper suspension structure 24 is fixed to an upper portion 61 of the connection structure 60 via threaded fasteners 62 engaging threaded bores 64 in the upper portion 61 of the connection structure 60. A pair of shafts 66 are secured to the lower suspension structure 26, via threaded fasteners 62' engaging threaded bores 67 in the shafts 66, so as to extend vertically upward. The connection structure 60 includes a pair of shaft-receiving bores 68, each receiving an associated shaft 66. A pair of set screws 69, as securing members, are engaged in threaded bores 70 in the connection structure 60 to adjustably secure the shafts 66 to the connection structure 60. Thus, a distance between the upper and lower suspension structures 24, 26 can be adjusted by sliding the connection structure 60 along the shafts 66. An optional support plate 72 can be provided between the shafts 66 and the lower suspension structure 26.

The connection structure 60 has clamping structure, generally indicated at 74, that can be of the type disclosed in U.S. Pat. No. 4,141,272, the entire content of which is hereby incorporated by reference into this disclosure. Thus, the clamping structure 74 includes an adjustable opening 76 configured to receive a holding rod 78 (FIG. 2) and to clamp upon and hold the holding rod 78 in fixed relation with respect to the connection structure 60. The clamping structure 74 also comprises a first clamp member 80 fixed to the connection structure 60 and a second clamp member 82 affixed via a hinge 84 with the first clamp member 80. The first and second clamp members 80, 82 define the adjustable opening 76. A threaded fastener 86 disposed through the second clamp member 82 and is threadedly engaged with the first clamp member 80 so that tightening of the fastener 86 via handle 87 moves the second clamp member 82 with respect to the first clamp member 80 to reduce a size of the adjustable opening 76 and thus clamp on the holding rod 78.

Figure 6:
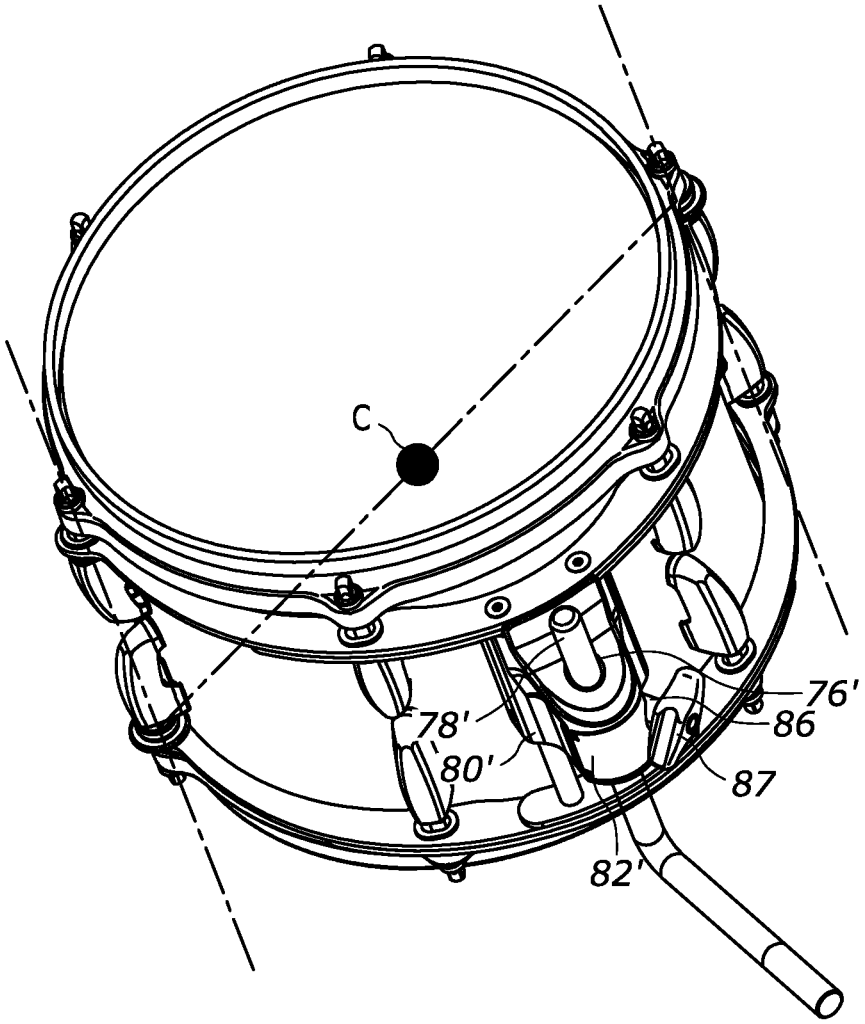
FIG. 6 is a perspective view of a suspension system having a clamping structure in accordance with a second exemplary embodiment for receiving an L-arm.
Figure 7:
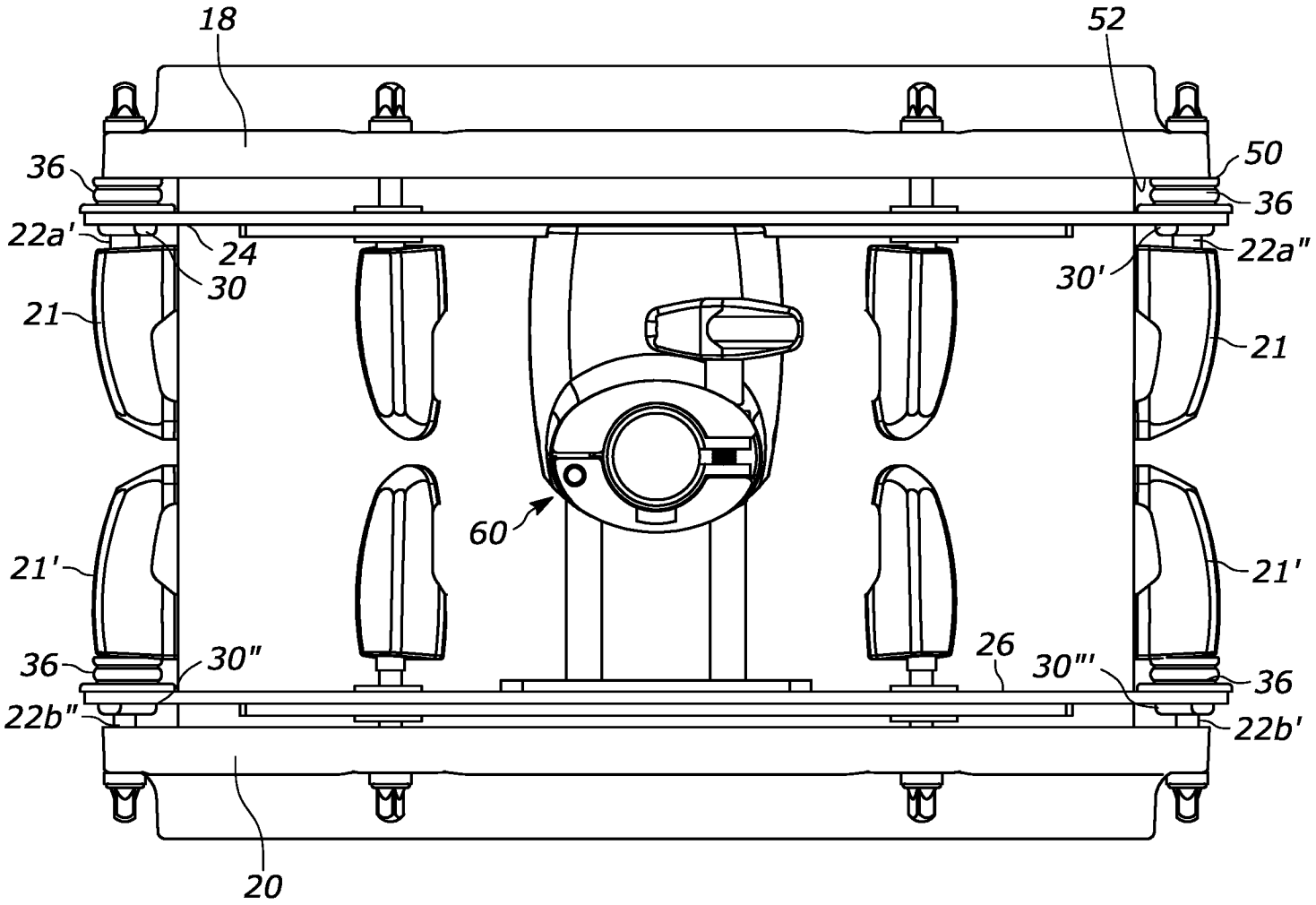
FIG. 7 is a side view of the suspension system of FIG. 2, shown mounted to a drum at four support locations.
Figure 8A:
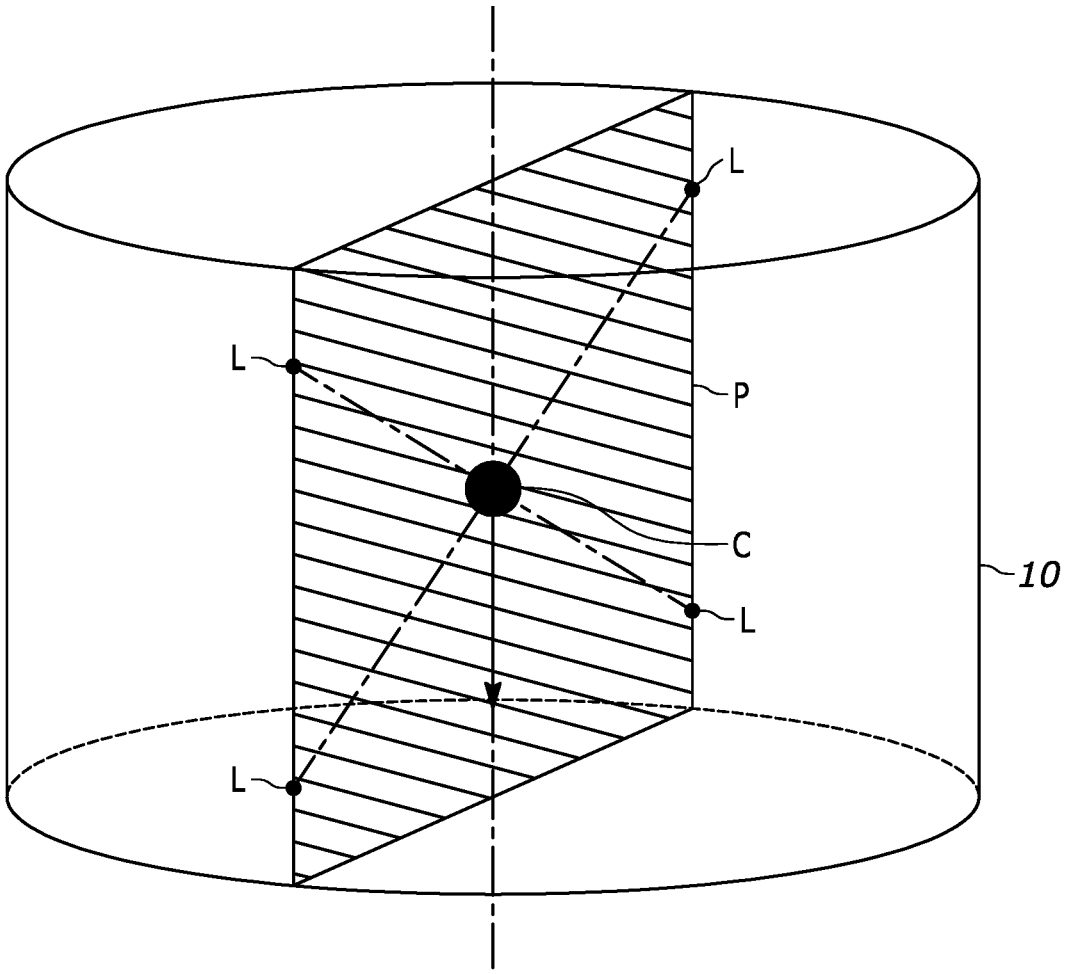
FIG. 8A is a schematic view of the drum of FIG. 7 showing a plane of the four support locations along a center of gravity of the drum when the drum is in a horizonal orientation.
Figure 8B:
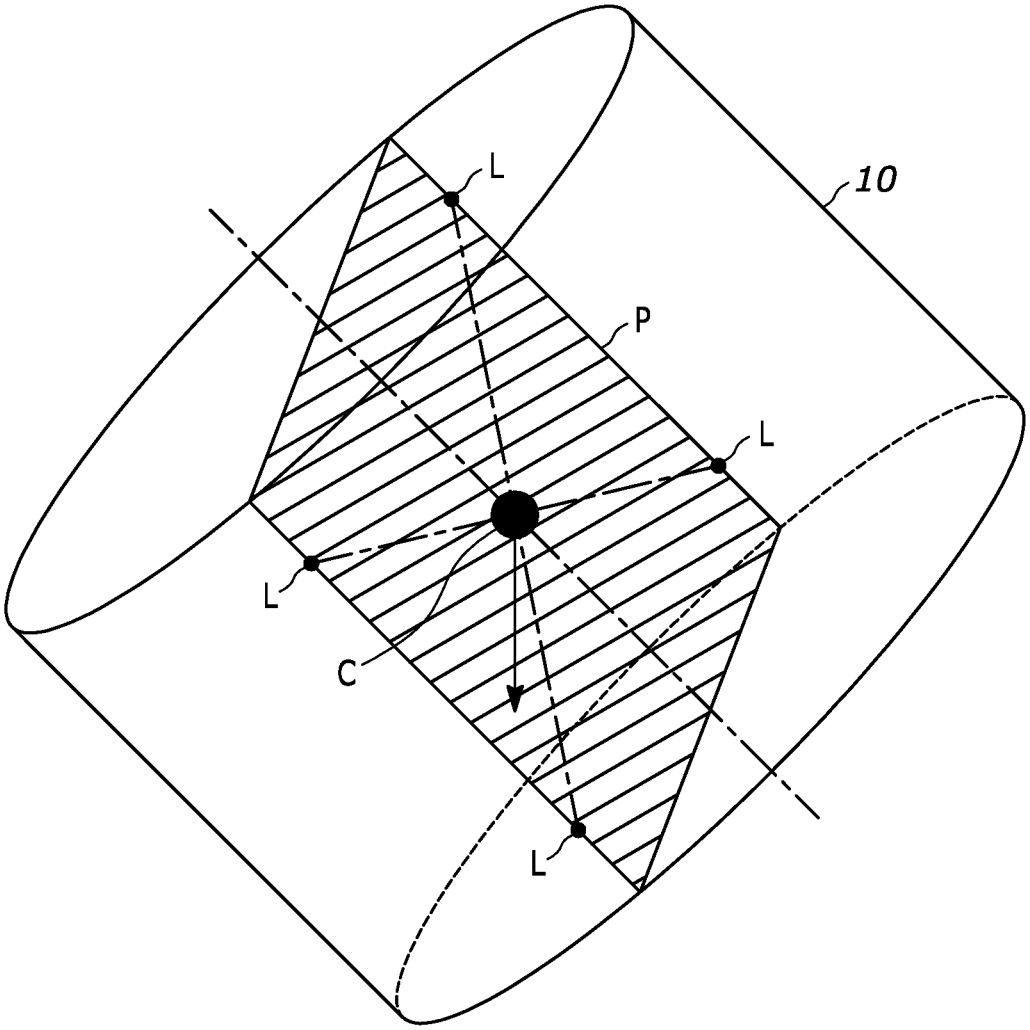
FIG. 8B is a schematic view of the drum of FIG. 7, showing the plane of four support locations along a center of gravity of the drum when the drum is oriented at an angle with respect to horizontal.
Figure 9:
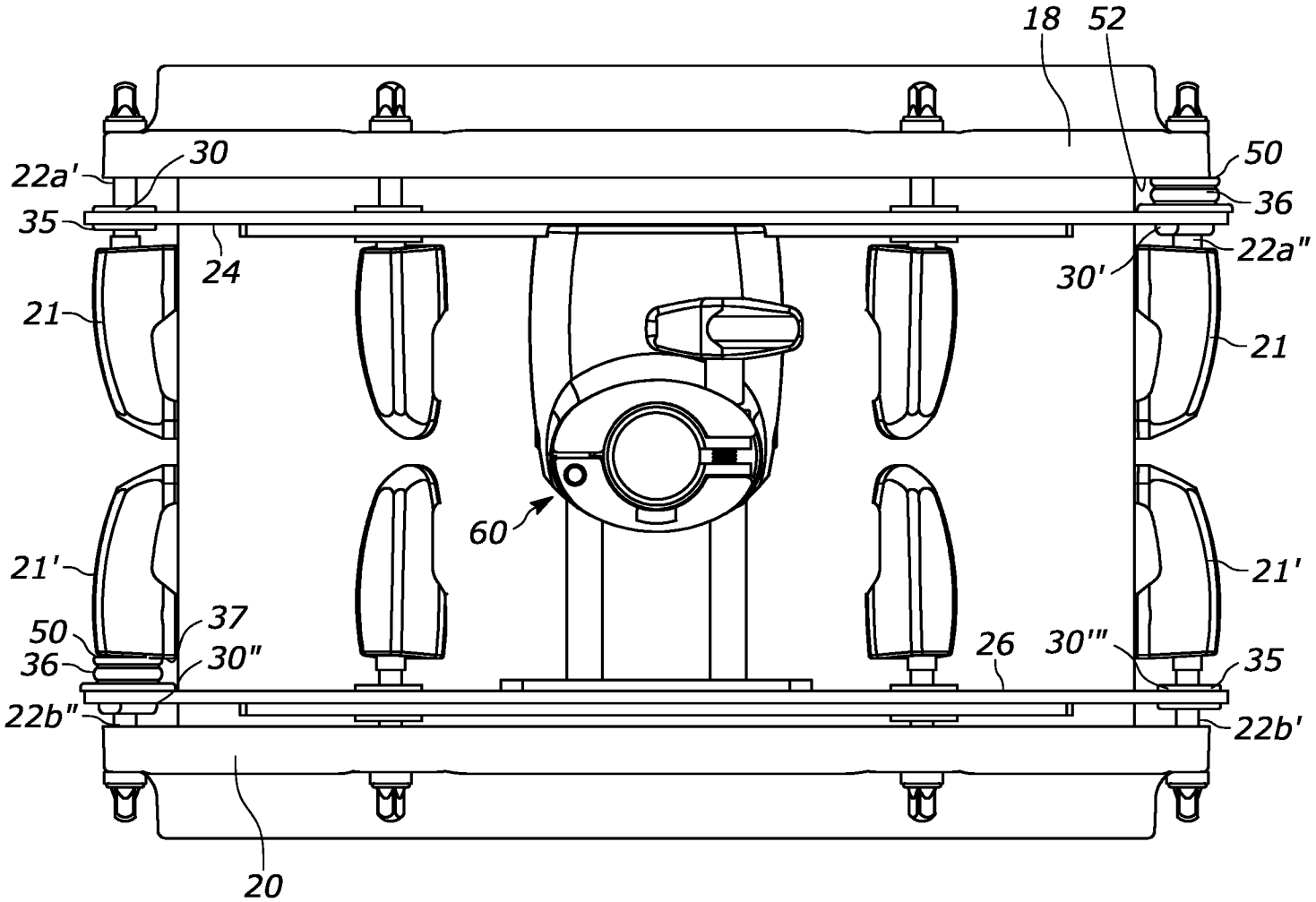
FIG. 9 is a side view of the suspension system of FIG. 2, shown mounted to a drum at two support locations.
Figure 10A:
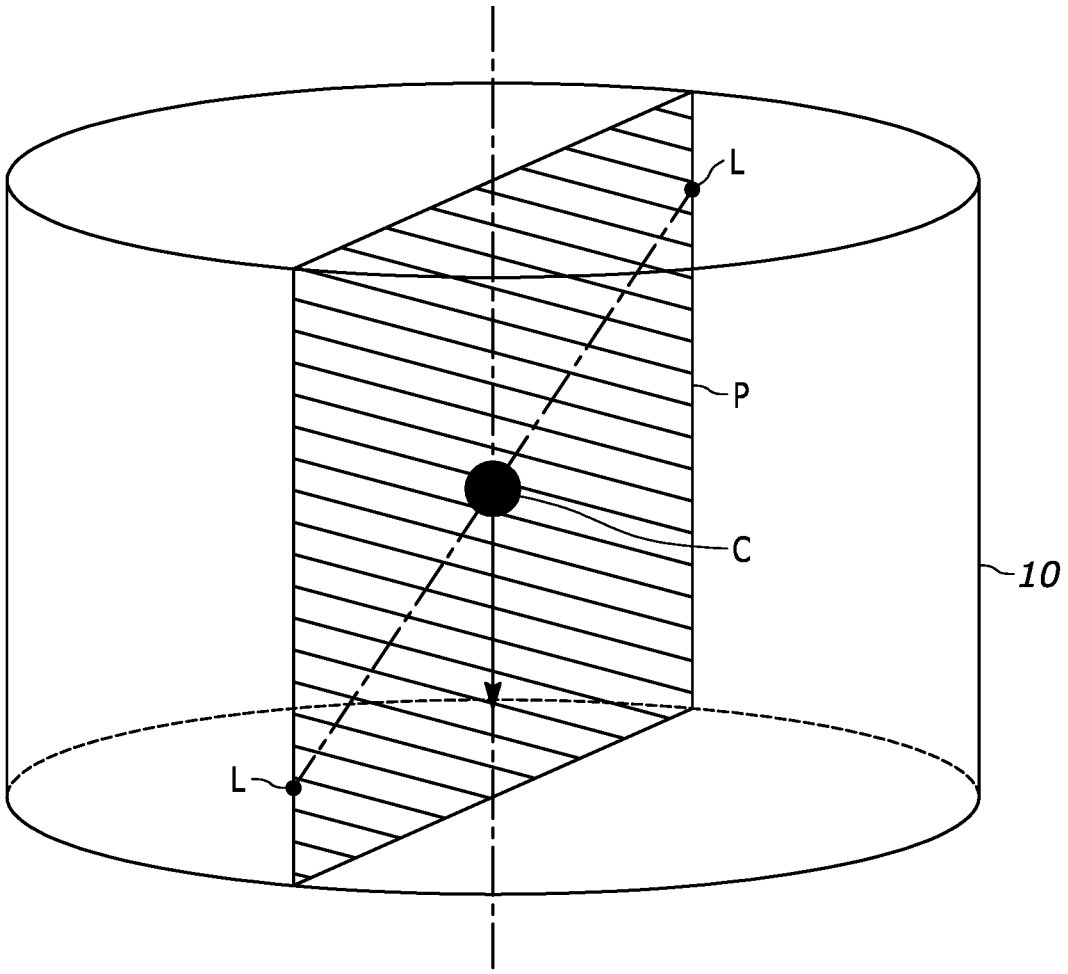
FIG. 10A is a schematic view of the drum of FIG. 9 showing a plane of the two support locations along a center of gravity of the drum when the drum is in a horizonal orientation.
Figure 10B:
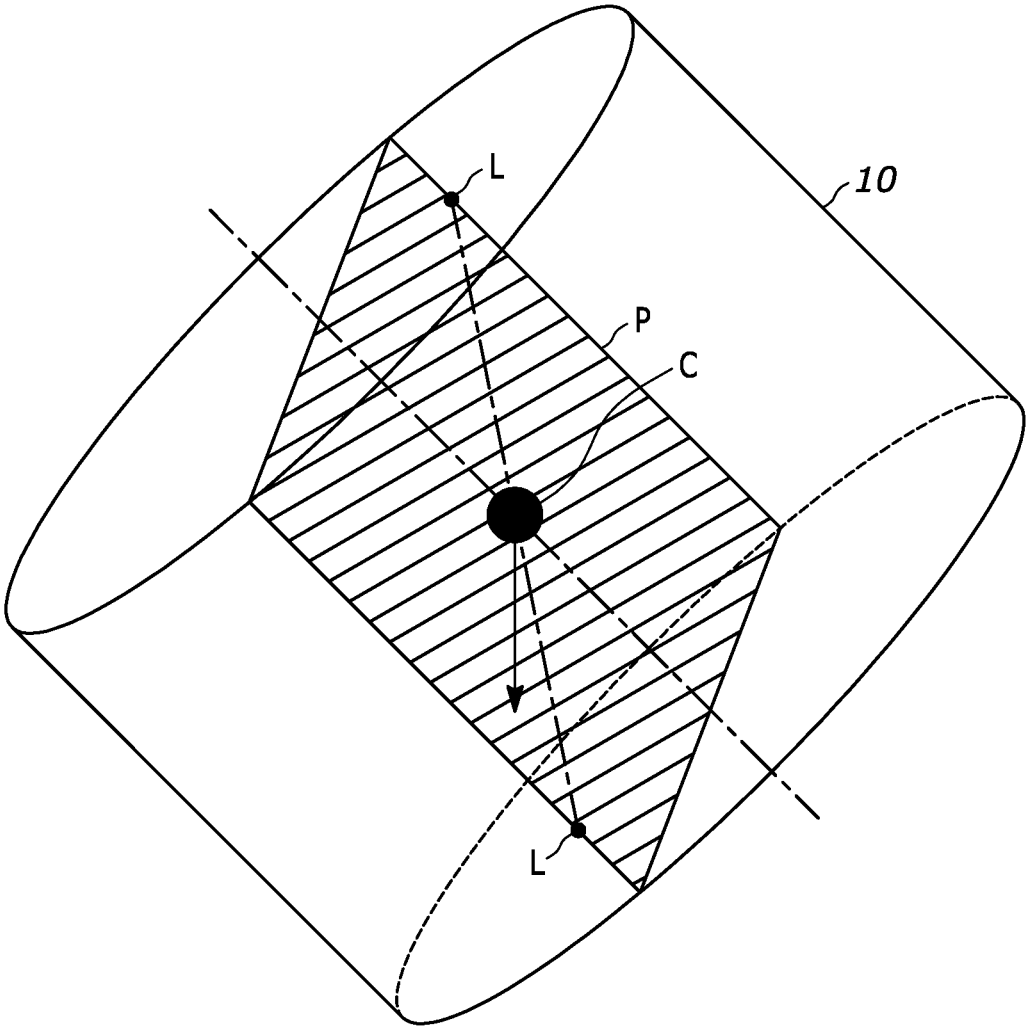
FIG. 10B is a schematic view of the drum of FIG. 9, showing the plane of the two support locations along a center of gravity of the drum when the drum is oriented at an angle with respect to horizontal.
Figure 11:
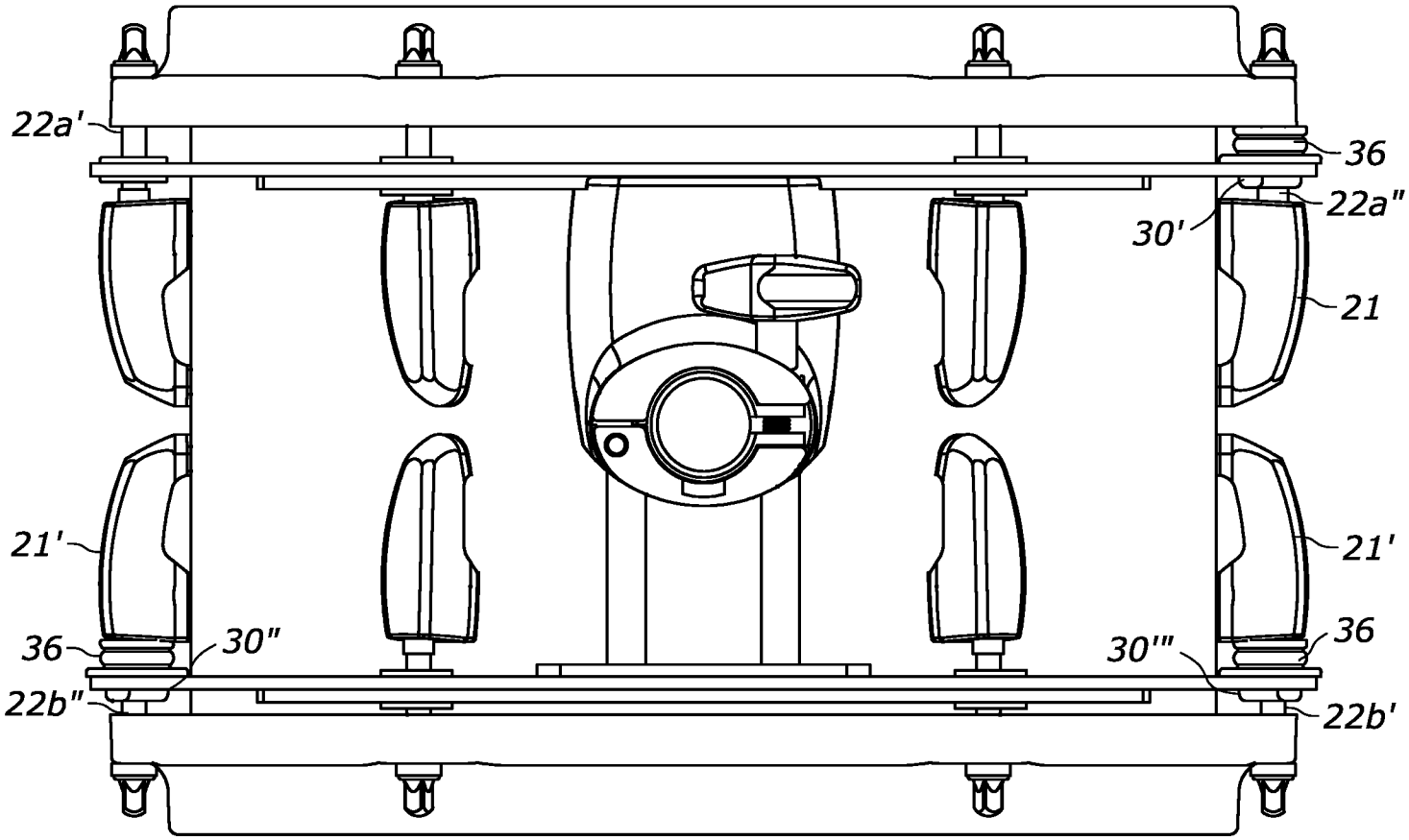
FIG. 11 is a side view of the suspension system of FIG. 2, shown mounted to a drum at three support locations.

In the embodiment of FIGS. 2 and 3, the clamp members 80, 82 are configured to define opening 76 so as to receive a standard ⅞" holding rod 78 in a horizontal manner However, with reference to FIG. 6, it can be appreciated that the clamp members 80', 82' can be provided to define the opening 76' so as to receive a conventional L-arm 78' (holding rod) in a vertical manner Each vibration isolation member 36 is configured to isolate vibration between the drum 10 and the suspension structures 24, 26 at support locations. FIGS. 2 and 7 show four support locations at tensioning rods 22*a*', 22*a*", 22*b*' and 22*b*" and respective mounting holes 30, 30', 30'" and 30", each having a vibration isolation member 36 therein; FIG. 9 shows two support locations at tensioning rods 22*a*", 22*b*" respective mounting holes 30' and 30", each having a vibration isolation member 36 therein; and FIG. 11 shows three support locations at tensioning rods 22*a*", 22*b*' and 22*b*" and respective mounting holes 30', 30'" and 30", each having a vibration isolation member 36 therein. Thus, the minimal amount of support locations is two. When the suspension system 12 is mounted to the drum 10 with each mounting hole 30' and 30" and associated vibration isolation member 36 receiving a respective tensioning rod 22*a*", 22*b*" at a support location, with reference to FIG. 9, at one side of the drum, the upwardly facing surface 50 of the vibration isolation member 36 mounted in one upper mounting hole 30' at tensioning rod 22*a*" is configured to engage the downwardly facing surface 52 of the upper die cast drum hoop 18 and on the opposing side of the drum, the upwardly facing surface 50 of the vibration isolation member 36 mounted in one lower mounting hole 30" at tensioning rod 22*b*" is configured to engage a downwardly facing surface 37 of a lower lug 21' to support weight of the drum 10 upwardly. In FIG. 9, the upper mounting hole 30 associated with the tensioning rod 22*a*' and the lower mounting hole 30'" associated with tensioning rod 22*b*' each includes a rubber insert 35 since these are not support locations. Thus, the suspension system 12 is constructed and arranged to prevent a moment force on the drum 10 when the drum is oriented in a horizontal position (see FIG. 10A for two support locations and FIG. 8A for four support locations) and in a position angled with respect to the horizontal position (see FIG. 10B for two support locations and FIG. 8B for four support locations) due to the support locations being oriented along a plane P of the center of gravity C of the drum 10 and thus balanced with respect to the center of gravity C. Prevention of a moment force also results when three support locations are used as in FIG. 11.

Figure 12:
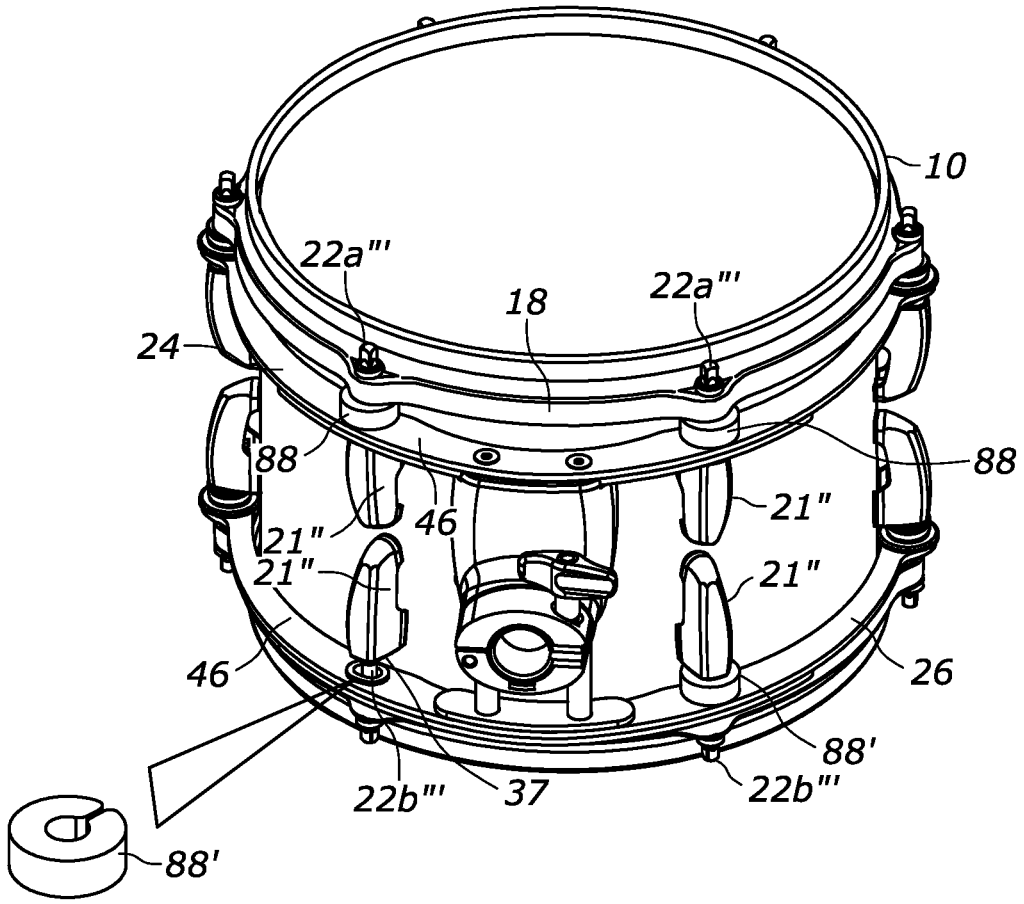
FIG. 12 is a front perspective view of the support system FIG. 2 mounted on a drum, showing rubber spacers installed between an upper suspension structure and an upper hoop and between a lower suspension structure and lugs.

With the drum 10 is used in a live concert, some sound engineers do not like too much sustain. With reference to FIG. 12, when time for a sound check is limited, a split-ring rubber spacer 88 can be placed about one or more tensioning rod 22*a*'" (non-support locations) between the drum hoop 18 and the upwardly facing surface 46 of the upper suspension structure 24 and/or a split-ring rubber spacer 88' can be placed about one or more tensioning rods 22*b*'" (non-support locations) between the downwardly facing surface 37 of a lower lug 21" and the upwardly facing surface 46 of the lower suspension member 26. By adjusting the spacer 88, 88' (one to four can be used), one can instantly change the characteristics of the suspension system 12 and adjust the sound of the drum 10.

Figure 13:
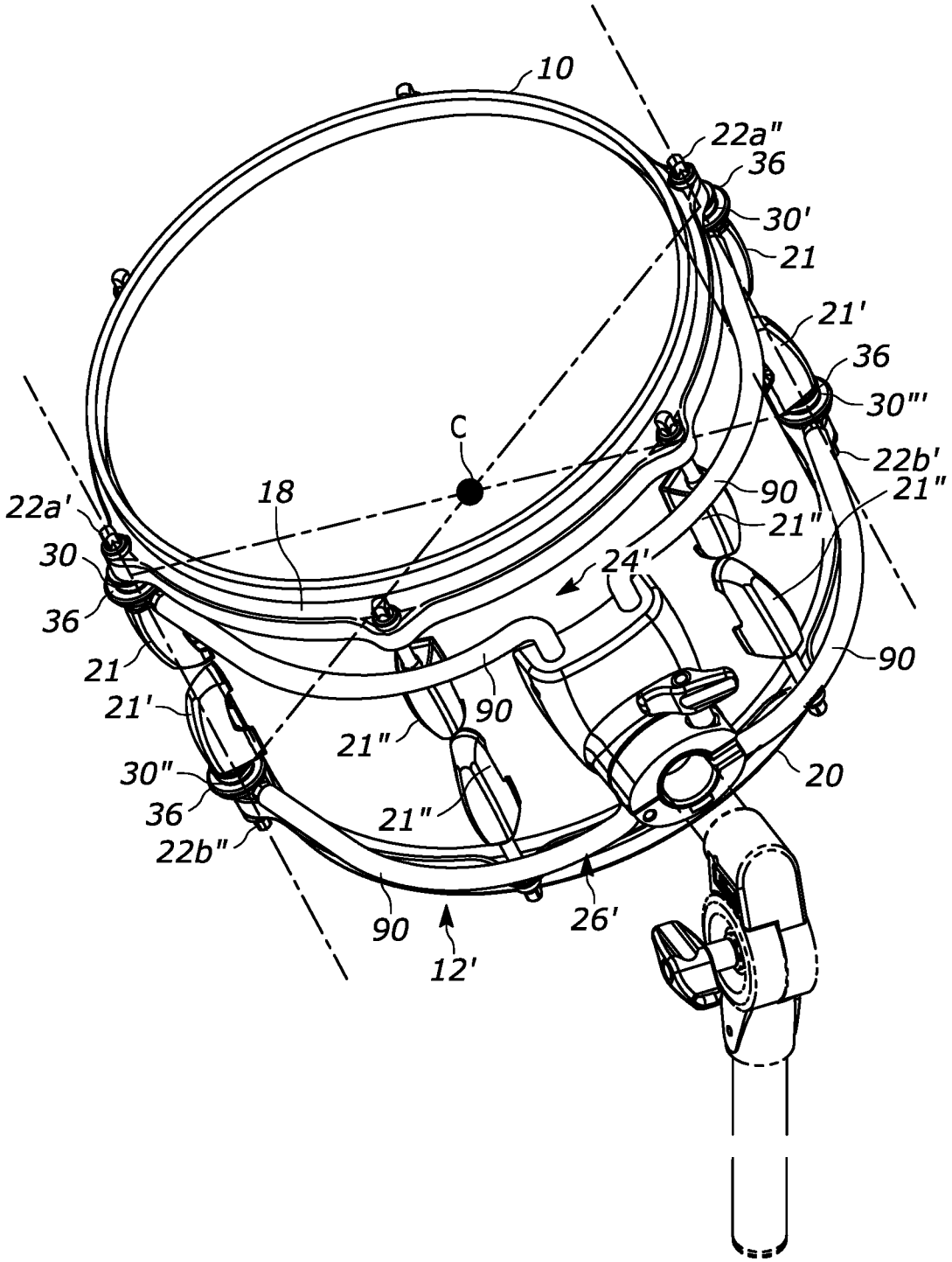
FIG. 13 is a perspective view of a suspension system in accordance with a second exemplary embodiment of the present disclosure, shown mounted to a drum.
Figure 14:
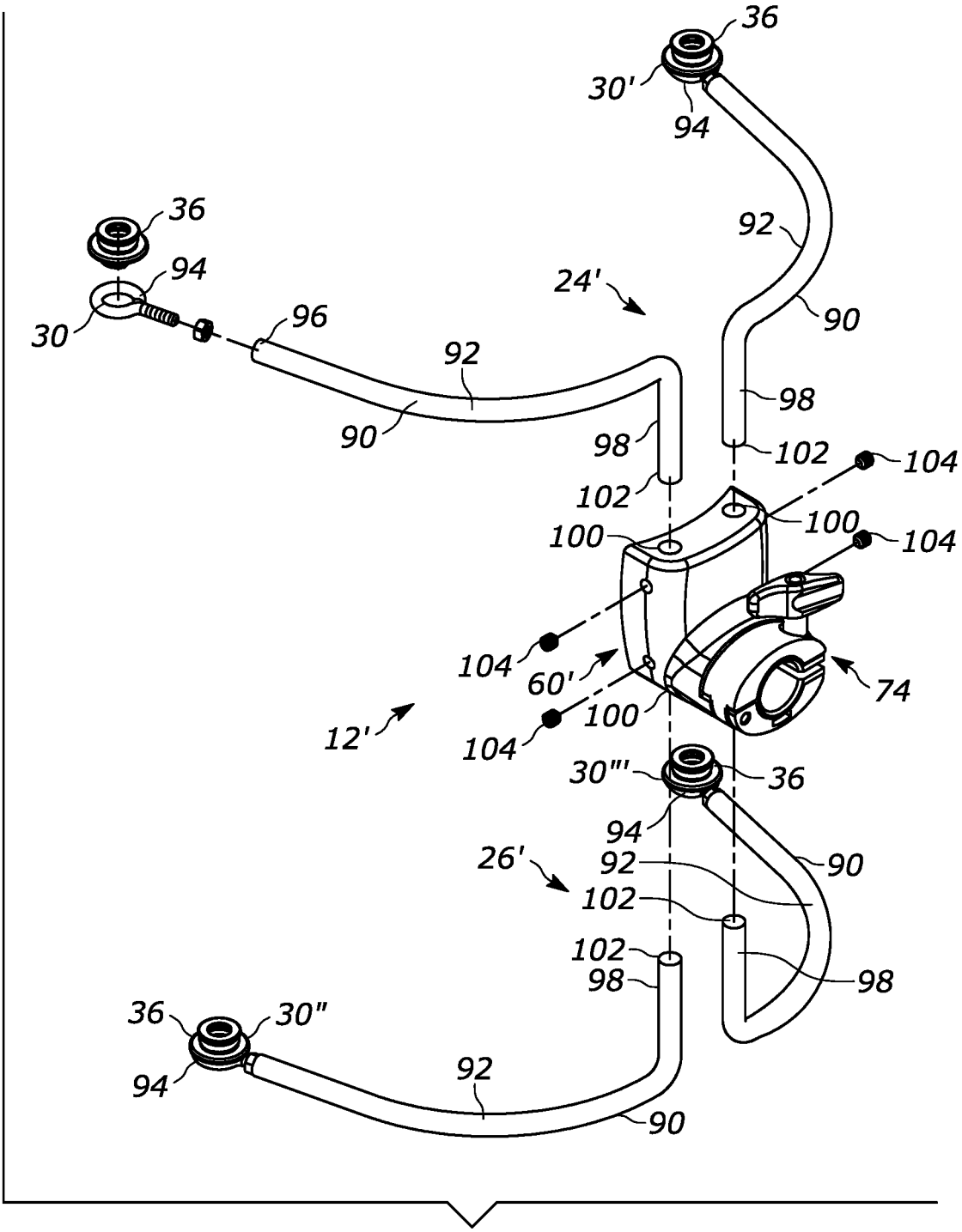
FIG. 14 is an exploded view of the suspension system of FIG. 13.

With reference to FIGS. 13 and 14, a second embodiment of a suspension system 12' is shown that configured to support the drum 10 at four support locations. The suspension system 12' includes an upper suspension structure, generally indicated at 24' and a lower suspension structure, generally indicated at 26'. Each of the upper and lower suspension structures 24', 26' includes a pair of support rods 90. As best shown in FIG. 14, each support rod 90 includes a first, generally arcuate portion 92 having an eye bolt 94 couped to the distal end 96 of the first portion 92 thereof. Each eyebolt 94 defines a mounting hole. One mounting hole 30 in the upper suspension structure 24' and one mounting hole 30''' in the lower suspension structure 26' that is disposed 180 degrees apart from the one mounting hole 30 in the upper suspension structure 24' define mounting holes pairs. Another set of mounting hole pairs is defined by mounting holes 30' and 30''. Thus, as shown in FIG. 13, mounting hole 30 is configured to receive tensioning rod 22*a*', the mounting hole 30''' is configured to receive tensioning rod 22*b*', mounting hole 30' is configured to receive tensioning rod 22*a*'', and mounting hole 30'' is configured to receive tensioning rod 22*b*''. In the embodiment of FIGS. 13-14, each mounting hole includes an associated vibration isolation member 36 therein.

Each support rod 90 also includes a second, linear portion 98 disposed generally 90 degrees with respect to the first portion 92. The connection structure 60' includes bores 100 therein, with ends 102 of each second portion 98 of each support rod 90 being adjustably received in an associated bore 100 to thereby adjust a spacing between the upper and lower support structures. Each support rod 90 can also be adjusted for rotation. A securing member 104, preferably in the form of a set screw secures each second portion 98 of each support rod 90 to the connection structure 60'. The connection structure 60' has clamping structure, generally indicated at 74, that is identical to that of FIG. 3. It can be appreciated that the clamping structure 74 can be of the type for an L-rod as in FIG. 6.

As shown in FIG. 13, each support rod 90 is configured to surround a portion of a circumference of the drum 10 when mounted thereon near the respective upper and lower drum hoops 18, 20. As shown, each support rod 90 is configured to pass over the lugs 21''.

Figure 15:
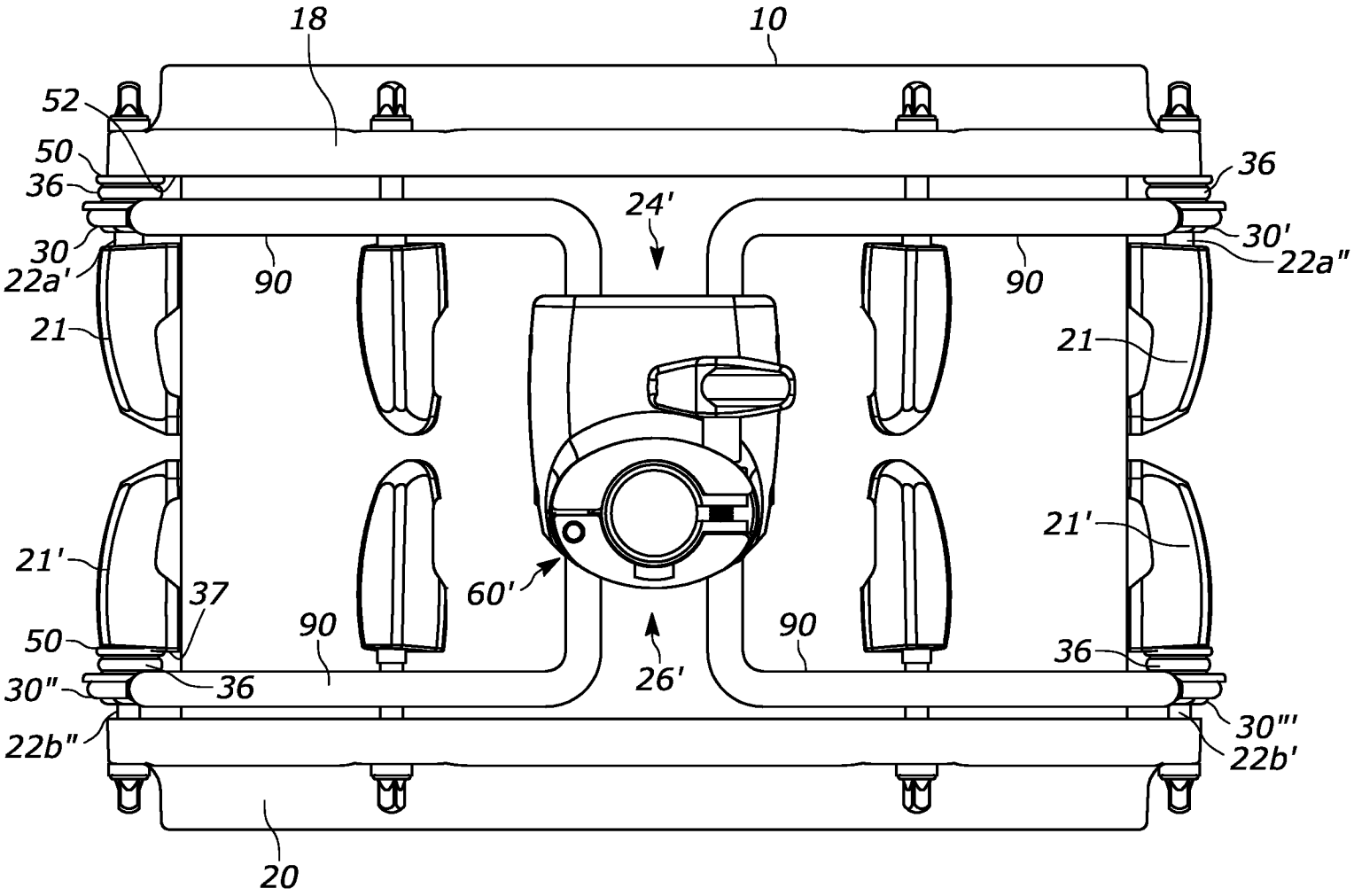
FIG. 15 is a side view of the suspension system of FIG. 13, shown mounted to a drum at four support locations.
Figure 16:
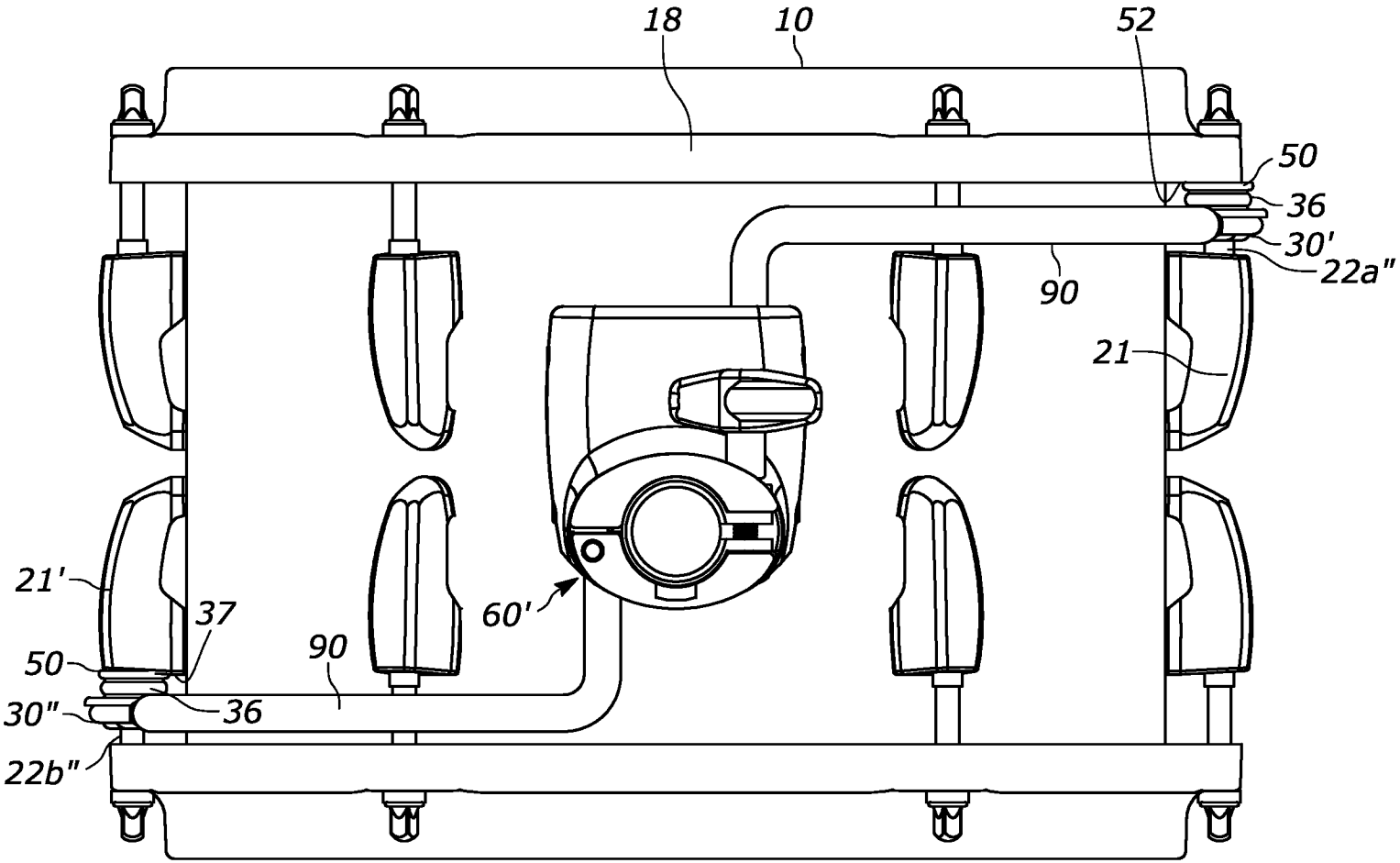
FIG. 16 is a side view of the suspension system of FIG. 13, shown mounted to a drum at two support locations.
Figure 17:
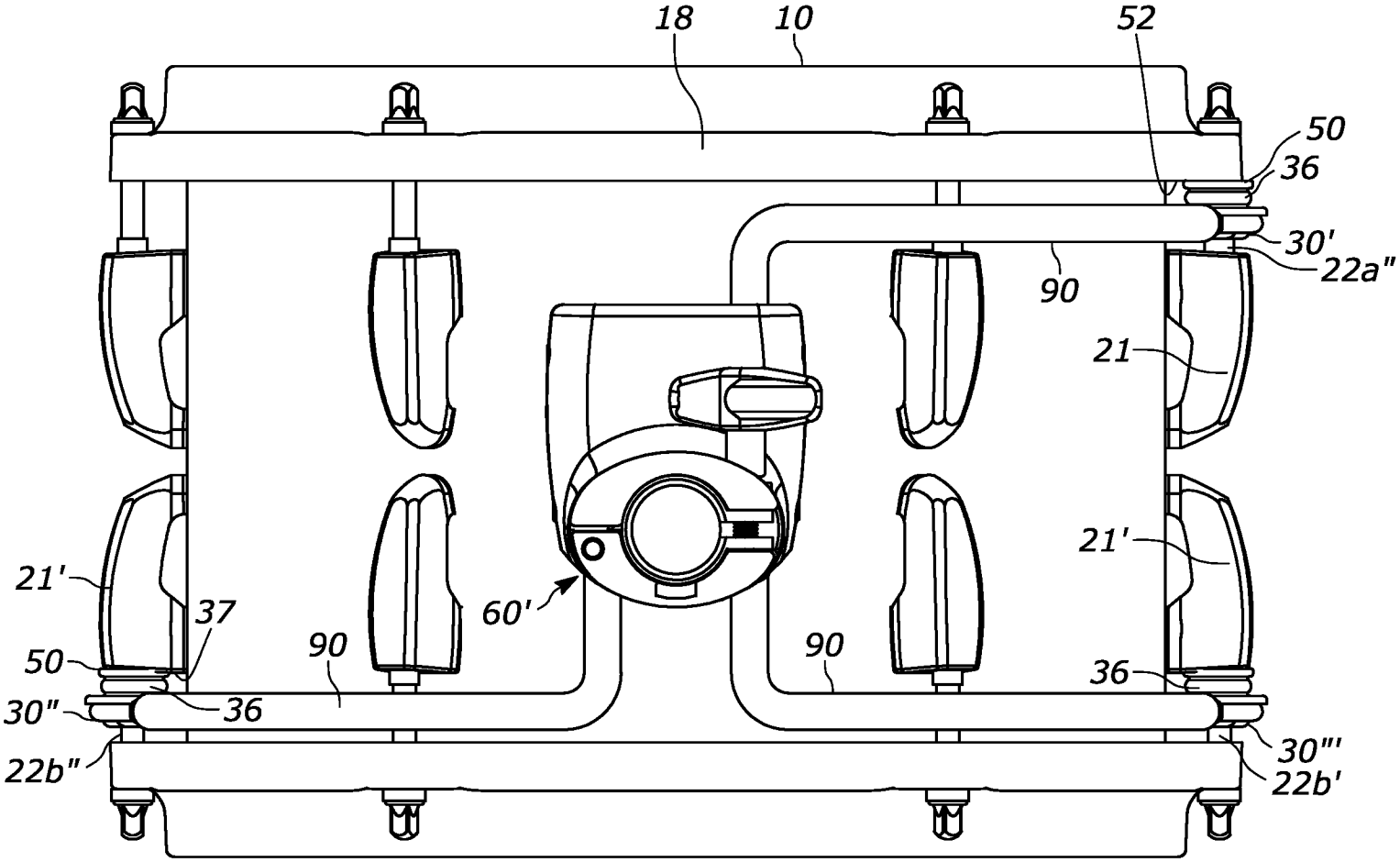
FIG. 17 is a side view of the suspension system of FIG. 13, shown mounted to a drum at three support locations.

Each vibration isolation member 36 is configured to isolate vibration between the drum 10 and the suspension structures 24', 26' at a support location. FIGS. 13 and 15 show four support locations at tensioning rods 22*a*', 22*a*'', 22*b*' and 22*b*'' and respective mounting holes 30, 30', 30''' and 30'', each having a vibration isolation member 36 therein. Thus, all four support rods 90 are needed. FIG. 16 shows two support locations at tensioning rods 22*a*'' and 22*b*'' and respective mounting holes 30' and 30'', each having a vibration isolation member 36 therein. Thus, only two support rods 90 are needed. FIG. 17 shows three support locations at tensioning rods 22*a*'', 22*b*' and 22*b*'' and respective mounting holes 30', 30''' and 30'', each having a vibration isolation member 36 therein. Thus, only three support rods 90 are needed. Hence, the minimal amount of support locations and support rods 90 is two. When the suspension system 12' is mounted to the drum 10 with each mounting hole 30' and 30'' and associated vibration isolation member 36 receiving a respective tensioning rod 22*a*'', 22*b*'' at a support location, with reference to FIG. 16, the upwardly facing surface 50 of the vibration isolation member 36 mounted in one upper mounting hole 30' at tensioning rod 22*a*'' is configured to engage a downwardly facing surface 52 of the upper die cast drum hoop 18 and the upwardly facing surface 50 of the vibration isolation member 36 mounted in one lower mounting hole 30'' at tensioning rod 22*b*'' is configured to engage a downwardly facing surface 37 of a lower lug 21' to support weight of the drum 10 upwardly. Thus, the suspension system 12' is constructed and arranged to prevent a moment force on the drum 10 when the drum is oriented in a horizontal position and in a position angled with respect to the horizontal position due to the support locations being oriented along a plane P of the center of gravity C of the drum 10 and thus balanced with respect to the center of gravity C in the manner disclosed above with regard to FIGS. 8A, 8B, 10A and 10B. This is true when two, three, or four support locations are used.

Thus, the suspension systems 12, 12' advantageously does not cause drum head deformation and thus ensures balance of the drum 10 no matter how the drum is oriented upon mounting.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. The specification describes specific examples to accomplish a more general goal that may be accomplished in another way.

What is claimed is:

1. A suspension system for a drum, the drum having a cylindrical drum shell, upper and lower drum heads fitted over respective first and second opposing ends of the drum shell, upper and lower drum hoops on the shell and retaining the respective upper and lower drum heads to the shell, upper and lower of lugs fixed to portions of a periphery of the drum shell, a plurality of adjustable upper and lower tensioning rods securing the respective upper and lower drum hoops to the respective upper and lower lugs, certain pairs of tensioning rods being disposed 180 degrees apart with regard to a circumference of the drum, the suspension system comprising:

upper and lower suspension structures each configured to surround a portion of a circumference of the drum when mounted thereon near the respective upper and lower drum hoops, each of the upper and lower suspension structures having at least one distal end with each distal end having a mounting hole thereby defining a mounting hole pair including at least one upper mounting hole in the upper suspension structure and at least one lower mounting hole in the lower suspension structure such that the at least one lower mounting hole is disposed 180 degrees apart from the at least one upper mounting hole, the at least one upper mounting hole being configured to receive at least one tensioning rod of a certain pair of tensioning rods, and the at least one lower mounting hole being configured to receive the other tensioning rod of the certain pair of tensioning rods, a connection structure mounted between the upper and lower suspension structures and configured for adjusting a spacing between the upper and lower suspension structures, the connection structure having clamping structure including an adjustable opening configured to receive a holding rod and to clamp upon and hold the holding rod in fixed relation with respect to the connection structure, and a vibration isolation member removably disposed in the at least one upper mounting hole and the at least one lower mounting hole to define support locations to support the drum when installed with respect to the suspension structures, the vibration isolation members having a bore there-through and being configured to isolate vibration between the drum and the suspension structures, wherein, when the suspension system is mounted to the drum by each mounting hole and associated vibration isolation member receiving an associated tensioning rod at a support location, the vibration isolation member mounted in the at least one upper mounting hole is configured to engage a downwardly facing surface of the upper drum hoop and the vibration isolation member mounted in the at least one lower mounting hole is configured to engage a downwardly facing surface of a lower lug to support weight of the drum upwardly, and wherein the suspension system is constructed and arranged to prevent a moment force on the drum when the drum is oriented in a horizontal position and in a position angled with respect to the horizontal position due to the support locations being oriented to be balanced with respect to a center of gravity of the drum.

2. The suspension system of claim 1, wherein each of the upper and lower suspension structures has a pair of distal ends with each distal end having a mounting hole, with one mounting hole in the upper suspension structure and one mounting hole in the lower suspension structure that are disposed 180 degrees apart defining a mounting hole pair.

3. The suspension system of claim 1, wherein the connection structure is fixedly mounted to one of the upper or lower suspension structures, the connection structure including at least one shaft-receiving bore therein, the system further comprising:

at least one shaft fixed to the other of the upper or lower suspension structures and adjustably received by the shaft-receiving bore of the connection structure so that a spacing between the upper and lower suspension structures can be adjusted, and a securing member to a secure the at least one shaft to the connection structure.

4. The suspension system of claim 3, wherein the securing member is a set screw.

5. The suspension system of claim 3, wherein a pair of shafts are received in a pair of shaft-receiving bores.

6. The suspension system of claim 1, wherein each of the upper and lower suspension structures is the form of at least one flat, arc-shaped plate.

7. The suspension system of claim 1, wherein each mounting hole is in the form of an elongated slot arranged so as to not be parallel to another slot of each suspension structure to prevent slip of the suspension system when mounted on the drum when the drum is tilted in a circumferential direction.

8. The suspension system of claim 6, wherein each of the upper and lower suspension structures includes a pair of secondary mounting holes spaced from the distal end and constructed and arranged to receive an associated tension rod therein, in a floating manner.

9. The suspension system of claim 8, further comprising a split-ring rubber spacer constructed and arranged to be placed around at least one of the tensioning rods at non-support locations 1) between a downwardly facing surface of a lug and the upwardly facing surface of the lower suspension member, and/or 2) between a downwardly facing surface of the upper drum hoop and the upwardly facing surface of the upper suspension structure to change a characteristics of the suspension system and adjust the sound of the drum.

10. The suspension system of claim 1, wherein the clamping structure comprises a first clamp member fixed to the connection structure; a second clamp member affixed via a hinge with the first clamp member, with the first and second clamp members defining the adjustable opening; and a threaded fastener disposed through the second clamp member and threadedly engaged with the first clamp member, whereby tightening of the fastener moves the second clamp member with respect to the first clamp member to reduce a size of the adjustable opening.

11. The suspension system of claim 1, wherein each of the upper and lower suspension structures comprises at least one support rod.

12. The suspension system of claim 11, wherein each support rod comprises: a first portion having an eye bolt couped to the distal end of the first portion thereof, the eyebolt defining the mounting hole; and a second portion disposed generally 90 degrees with respect to the first portion, wherein the connection structure includes bores therein, ends of each second portion of each support rod being adjustably received in an associated bore to thereby adjust a spacing between the upper and lower support structures and adjust rotation of the support rod, the suspension system further comprising:

a securing member to a secure each second portion of each support rod to the connection structure.

13. The suspension system of claim 1, wherein each the vibration isolation member is configured so that a portion thereof extends beyond an upper surface of the suspension structures.

14. The suspension system of claim 13, wherein each vibration isolation member is a hollow rubber member having opposing ends, each hollow rubber member including a bellows portion associated with one of the ends to permit the vibration isolation member to buckle, at least the bellows portion extending beyond the upper surface of the suspension structures.

15. The suspension system of claim 14, in combination with the drum, wherein the upper and lower drum hoops are upper and lower metal hoops, wherein an upper end of the vibration isolation member mounted in the at least one upper mounting hole includes a spacer at an end thereof, with a surface of the spacer engaging the downwardly facing surface of the upper metal hoop.

16. The combination of claim 15, wherein an upper end of the vibration isolation member, mounted in the at least one lower mounting hole, is a planar end disposed generally adjacent to the bellows portion, with the planar end engaging the downwardly facing surface of the lower lug.

17. The suspension system of claim 14, in combination with the drum, wherein the upper and lower drum hoops are upper and lower die-cast hoops, wherein an upper end of the vibration isolation member, mounted in the at least one upper mounting hole, is a planar end disposed generally adjacent to the bellows portion, with the planar end engaging the downwardly facing surface of the upper die-cast hoop.

18. The combination of claim 17, wherein an upper end of the vibration isolation member, mounted in the at least one lower mounting hole, is a planar end disposed generally adjacent to the bellows portion, with the planar end engaging the downwardly facing surface of the lower lug.

19. A suspension system for a drum, the drum having a cylindrical drum shell, upper and lower drum heads fitted over respective first and second opposing ends of the drum shell, upper and lower drum hoops on the shell and retaining the respective upper and lower drum heads to the shell, upper and lower lugs fixed to portions of a periphery of the drum shell, a plurality of adjustable tensioning rods securing the respective upper and lower hoops to the respective upper and lower lugs, certain pairs of tensioning rods being disposed 180 degrees apart with respect to a circumference of the drum, the system comprising:

suspension structure configured to surround a portion of a circumference of the drum when mounted thereon, the suspension structure having mounting holes there-through with at least one pair of mounting holes being 180 degrees apart, and a connection structure mounted to the suspension structure, the connection structure having clamping structure to receive a hold a holding rod, a vibration isolation member removably disposed in the at least one pair of mounting holes to define support locations to support the drum when installed with respect to the suspension structure, the vibration isolation members having a bore there-through and being configured to isolate vibration between the drum and the suspension structure, wherein, when the suspension system is mounted to the drum via the at least one pair of mounting holes and an associated vibration isolation member receiving an associated tensioning rod at a support location, at least one of the vibration isolation member is configured to engage a portion of the upper drum hoop and at least one other vibration isolation member is configured to engage a downwardly facing surface of a lower lug to support weight of the drum upwardly, and wherein the suspension system is constructed and arranged to prevent a moment force on the drum when the drum is oriented in a horizontal position and in a position angled with respect to the horizontal position due to the support locations being oriented to be balanced with respect to a center of gravity of the drum.

20. The suspension system of claim 19, wherein the suspension structure includes upper and lower suspension structures with the connection structure mounted between the upper and lower suspension structures and configured to adjust a spacing between the upper and lower suspension structures.

* * * * *